US010797440B1

(12) United States Patent
Chen et al.

(10) Patent No.: US 10,797,440 B1
(45) Date of Patent: Oct. 6, 2020

(54) CONNECTOR ASSEMBLY WITH SLIDABLE FRAME FOR UNLOCKING LATCHES

(71) Applicant: Amphenol East Asia Limited Taiwan Branch (H.K.), Taoyuan (TW)

(72) Inventors: Chien-Ming Chen, Taoyuan (TW); Szu-Ting Liao, Taoyuan (TW)

(73) Assignee: AMPHENOL EAST ASIA LIMITED TAIWAN BRANCH (H.K.), Taoyuan (TW)

( * ) Notice: Subject to any disclaimer, the term of this patent is extended or adjusted under 35 U.S.C. 154(b) by 0 days.

(21) Appl. No.: 16/572,753

(22) Filed: Sep. 17, 2019

(30) Foreign Application Priority Data

May 22, 2019 (TW) ..... 108117707 A

(51) Int. Cl.
*H01R 13/627* (2006.01)
*H01R 13/639* (2006.01)
*H01R 13/631* (2006.01)

(52) U.S. Cl.
CPC ..... *H01R 13/639* (2013.01); *H01R 13/6273* (2013.01); *H01R 13/631* (2013.01)

(58) Field of Classification Search
USPC ..... 439/352
See application file for complete search history.

(56) References Cited

U.S. PATENT DOCUMENTS 3,569,903 A * 3/1971 Brishka ..... H01R 13/6277 439/352
3,711,816 A * 1/1973 Schumacher .... H01R 13/62933 439/352
4,872,736 A * 10/1989 Myers ..... G02B 6/3878 385/60
5,011,424 A * 4/1991 Simmons ..... H01R 13/6275 439/352
5,383,794 A * 1/1995 Davis ..... H01R 13/516 439/352
5,634,809 A * 6/1997 Hirai ..... H01R 13/6275 439/352
5,779,495 A * 7/1998 Dechelette ..... H01R 13/6275 439/353
7,857,651 B2 * 12/2010 Chen ..... H01R 13/5219 439/352
8,435,062 B2 * 5/2013 Lange ..... H01R 13/6335 439/350
8,496,495 B2 * 7/2013 Kari ..... H01R 13/6277 439/352
8,944,838 B2 * 2/2015 Mulfinger ..... G02B 6/3893 439/352

* cited by examiner

*Primary Examiner* — Neil Abrams
(74) *Attorney, Agent, or Firm* — Bacon & Thomas, PLLC

(57) ABSTRACT

A connector assembly has a slidable locking frame used for unlocking latches on a plug connector and a socket connector. When the plug connector and the socket connector are connected and the slidable locking frame is mounted around the plug connector and by use of a lifting force moves toward a top side of the plug connector, the two first locking units of the plug connector are pushed outward by the two pushing units of the slidable locking frame respectively, and disengaged, or unlocked, from the two fastening portions of the socket connector respectively, and the slidable locking frame unlocks the two first locking units simultaneously to prevent a user from pulling the plug connector forcibly away from the socket connector before full unlocking of the two locking units.

15 Claims, 10 Drawing Sheets

CONNECTOR ASSEMBLY WITH SLIDABLE FRAME FOR UNLOCKING LATCHES

FIELD OF THE INVENTION

The present disclosure relates to a connector assembly and more particularly to a connector assembly in which the plug connector is provided with a slidable locking frame that unlocks the plug connector automatically when moving upward.

BACKGROUND OF THE INVENTION

Due to the advancement of electronic and communication technologies, electronic devices are nowadays equipped with a variety of functions and have become indispensable tools in our daily lives. Some notable examples of such devices are mobile phones, which allow people in different parts of the world to communicate with one another, powerbanks, which can be carried around to supply electricity to mobile phones continuously; portable audio players, which satisfy our need to listen to music anywhere anytime; and personal computers, which are depended upon to help with all sorts of things.

In order to receive electronic signals and electric power from the outside, an electronic device (e.g., be it a smartphone, tablet computer, desktop computer, laptop computer, or digital camera) must be provided with a connector on the device body. As used herein, the term "connector" refers to a connecting device for use with electronic signals and/or electric power and to its accessories. Connectors can be viewed as bridges for all kinds of signals, and their quality affects the reliability of signal and/or current transmission and is therefore crucial to the operation of electronic devices. Connectors also allow a plurality of electronic devices to be connected as a complete system and to transmit electronic signals and/or electric power to one another. In fact, therefore, connectors are essential to electronic devices in that the latter cannot carry out their predetermined functions without the former.

Connector structures vary with their applications and installation locations in order to adapt to and meet user needs. For example, as the concept and use of intelligent vehicles become increasingly prevalent, the demand for automotive connectors is rising substantially. One of the challenges facing automotive connectors is that two connected automotive connectors in a vehicle may eventually come loose, if not separate, from each other as a result of the vibrations generated by the vehicle running on bumpy roads. To ensure secure connection, therefore, an automotive connector is generally provided with a locking structure, which, however, not only adds to the difficulty of design, but also entails additional locking and unlocking operations.

In light of the above, the inventor of the present disclosure designed an automotive connector assembly as shown in FIG. 1A and FIG. 1B. The automotive connector assembly 1 includes a plug connector 11, a socket connector 12, and two locking portions 13. The plug connector 11 and the socket connector 12 are configured to connect to each other, with their corresponding bilateral locking mechanisms coupled together. The two locking portions 13 are mounted respectively on the left and right sides of the assembly of the plug connector 11 and the socket connector 12 to further secure the plug connector 11 and the socket connector 12 in the connected state, thereby preventing the connectors 11 and 12 from separation under vibration. To disconnect the plug connector 11 from the socket connector 12, the two locking portions 13 are moved upward to expose the locking mechanisms so that the plug connector 11 and the socket connector 12 can be unlocked, and then separated, from each other.

The two separate locking portions 13, however, have the following inadequacy. When a user moves the locking portions 13 upward, one of the locking portions 13 may fail to reach the predetermined position without the user knowing it; that is to say, the user's operation may have unlocked the locking portions 13 only partially. Nevertheless, the fact that one of the locking portions 13 has been unlocked by being moved upward to the predetermined position may create the illusion, or false tactile feel, that both locking portions 13 have been unlocked, thus encouraging the user to pull the plug connector 11 away from the socket connector 12. Should the plug connector 11 be pulled forcibly, either the plug connector 11 or the socket connector 12 will be damaged, and the entire automotive connector assembly 1 will be useless as a result. The issue to be addressed by the present disclosure, therefore, is to provide an effective solution to the foregoing problem so that a connector not only stays secure in place during use, but also can be unlocked with ease.

BRIEF SUMMARY OF THE INVENTION

In view of the fact that a conventional connector assembly with two separate locking portions tends to have one of the locking portions left unlocked and thus result in damage to the connector assembly, the inventor of the present disclosure incorporated years of practical experience in the design, processing, and manufacture of various signal and power connectors and the spirit of continued perfection into an extensive research and experiment and finally succeeded in developing a connector assembly with a slidable locking frame and the plug connector of the assembly. The invention is intended to increase the physical stability of two connected connectors but allow the connectors to be easily unlocked from each other so as to provide better user experience.

One objective of the present disclosure is to provide a connector assembly that has a slidable locking frame. The connector assembly includes a socket connector and a plug connector in addition to the slidable locking frame. The top side of the socket connector is provided with a socket connection portion, and each of the left and right sides of the socket connector is provided with a fastening portion. The bottom side of the plug connector is provided with a plug connection portion, and each of the left and right sides of the plug connector is provided with a first locking unit, wherein each first locking unit has a free-standing bottom end spaced apart from the corresponding left side or right side of the plug connector. Once the plug connector is physically connected to the socket connector, the socket connection portion and the plug connection portion are electrically connected, and the fastening portions are fastened to the first locking units respectively. The slidable locking frame is mountable around the plug connector, and each of the left and right sides of the slidable locking frame is provided with a pushing unit, wherein each pushing unit is corresponding to the inner side of the corresponding first locking unit. Once the plug connector is physically connected to the socket connector, the slidable locking frame can be moved toward the top side of the plug connector in order for the pushing units to push the first locking units outward respectively, thereby separating each first locking unit from the corresponding fastening portion and bringing the first locking units into the unlocked state. Now that the slidable locking frame pushes the two first locking units outward at the same time, the user is kept from pulling the plug connector forcibly away from the socket connector as may otherwise occur if the user's unlocking operation does not unlock, but is presumed by the user to have unlocked, both of the first locking units.

Another objective of the present disclosure is to provide a plug connector having a slidable locking frame. The bottom side of the plug connector is provided with a plug connection portion, and each of the left and right sides of the plug connector is provided with a first locking unit, wherein each first locking unit has a free-standing bottom end spaced apart from the corresponding left side or right side of the plug connector. Once the plug connector is connected to a socket connector, the plug connection portion is electrically connected to a socket connection portion of the socket connector, and the two first locking units are fastened to two fastening portions of the socket connector respectively. The slidable locking frame is mountable around the plug connector, and each of the left and right sides of the slidable locking frame is provided with a pushing unit, wherein each pushing unit is corresponding to the inner side of the corresponding first locking unit. Once the plug connector is physically connected to the socket connector, the slidable locking frame can be moved toward the top side of the plug connector in order for the pushing units to push the first locking units outward respectively, thereby separating each first locking unit from the corresponding fastening portion and bringing the first locking units into the unlocked state.

BRIEF DESCRIPTION OF THE SEVERAL VIEWS OF THE DRAWINGS

The objectives, technical features, and effects of the present disclosure can be better understood by referring to the following detailed description of some illustrative embodiments in conjunction with the accompanying drawings, in which.

DETAILED DESCRIPTION OF THE INVENTION

Figure 1A:
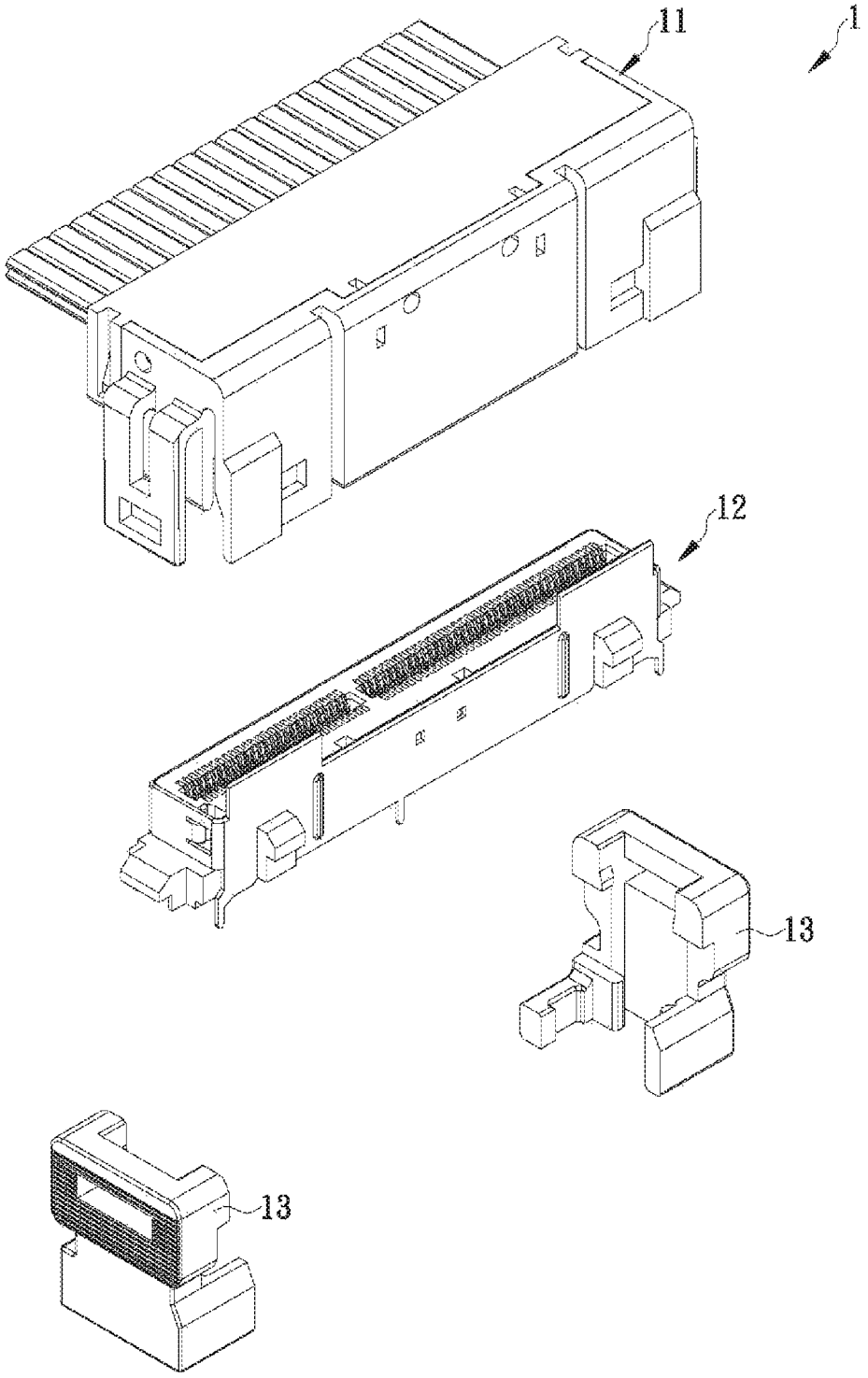
FIG. 1A(Prior Art)
FIG. 1A is an exploded perspective view of a conventional connector assembly.
Figure 1B:
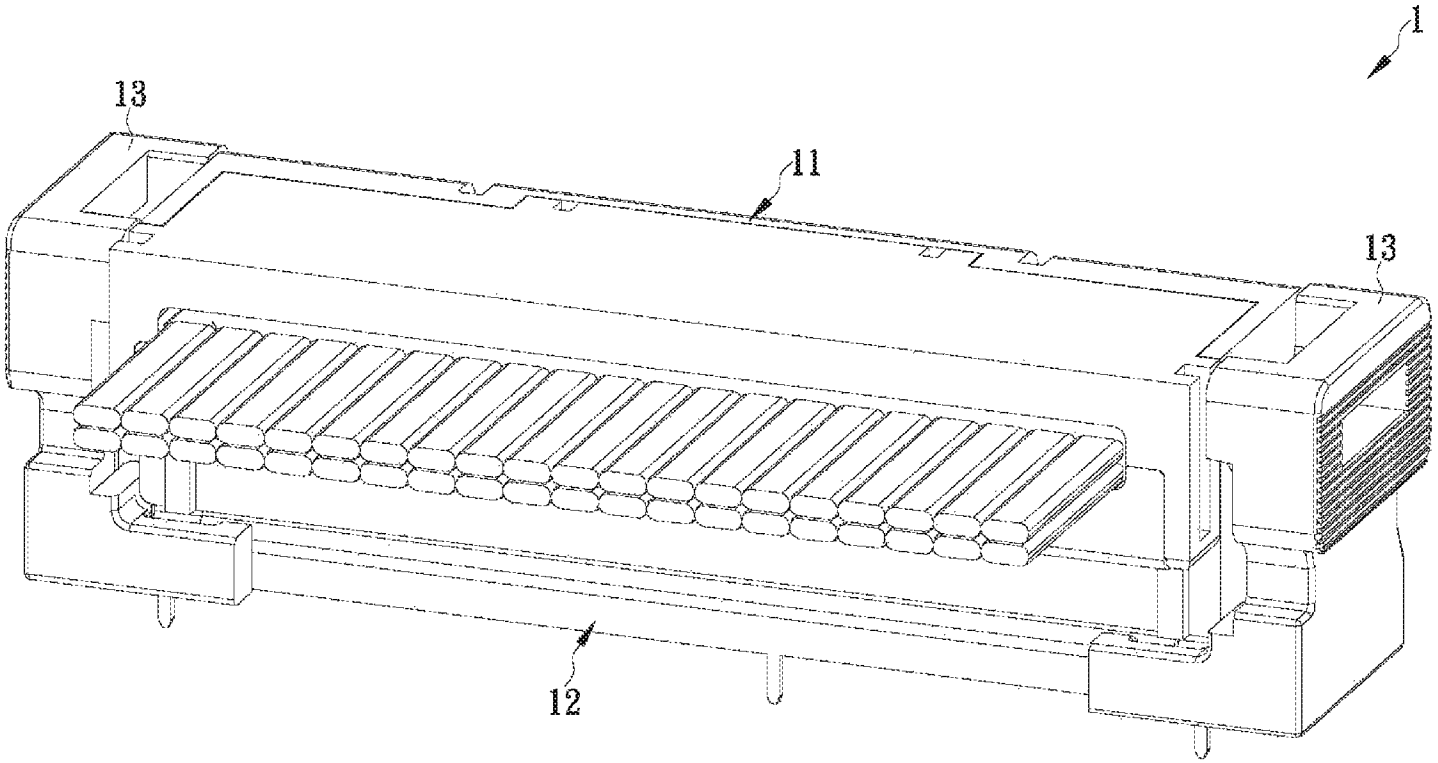
FIG. 1B(Prior Art)
FIG. 1B is an assembled perspective view of the conventional connector assembly in FIG. 1A.
Figure 2:
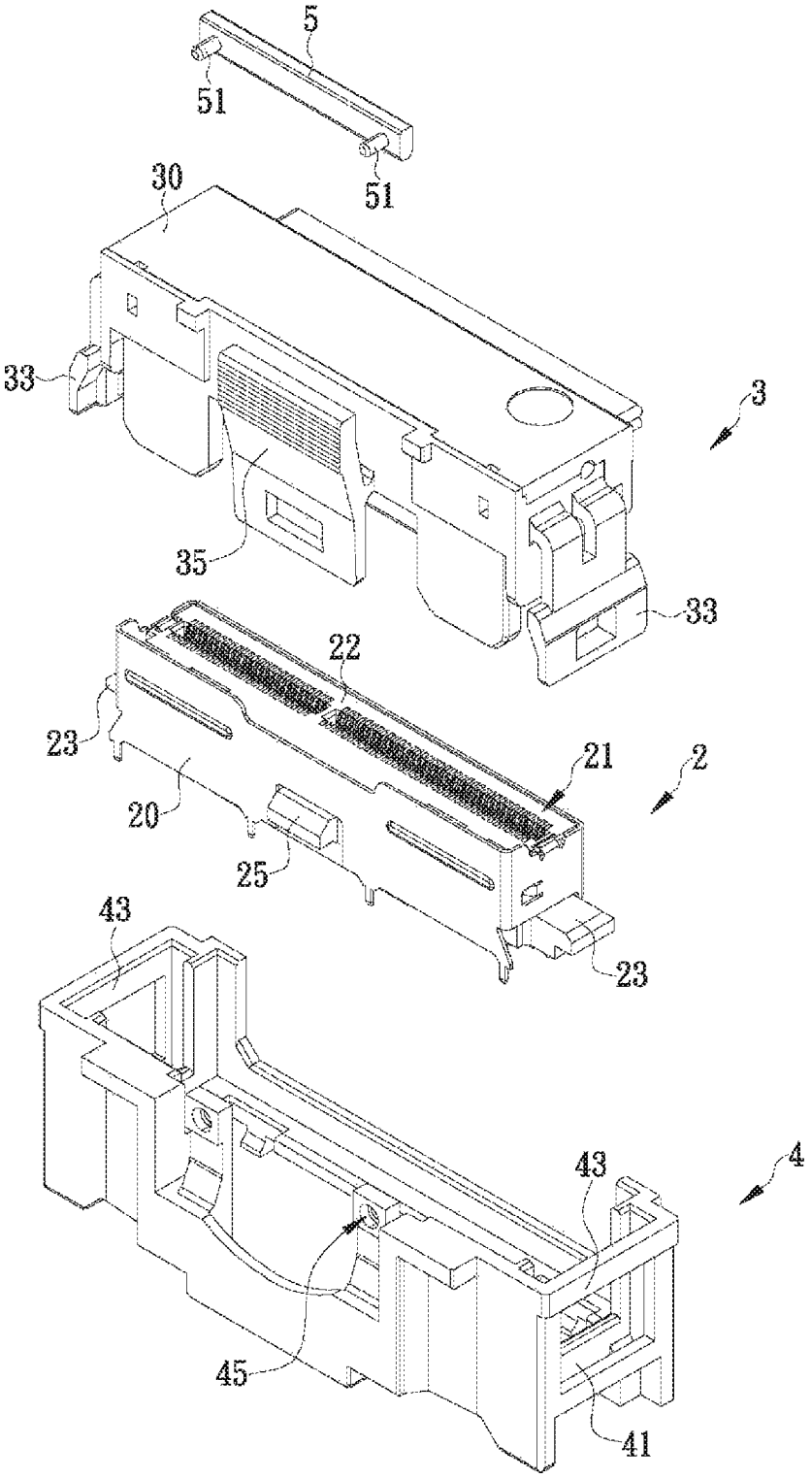
FIG. 2 is an exploded perspective view of a connector assembly according to the present disclosure.

The present disclosure discloses a connector assembly with a slidable locking frame and the plug connector of the connector assembly. Referring to FIG. 2, the connector assembly according to one embodiment of the present disclosure includes a socket connector 2, a plug connector 3, and a slidable locking frame 4. To facilitate description, the top side of each component of the connector assembly is defined as facing the top edge of FIG. 2, the bottom side of each component is defined as facing the bottom edge of FIG. 2, the left side of each component is defined as facing the upper left corner of FIG. 2, the right side of each component is defined as facing the lower right corner of FIG. 2, the front side of each component is defined as facing the lower left corner of FIG. 2, and the rear side of each component is defined as facing the upper right corner of FIG. 2. It is understood that the configuration of each component of the connector assembly is not limited to that depicted in FIG. 2. A manufacturer may adjust the configuration of each component according to product requirements, provided that the connector assembly has the structure and functions disclosed in the following embodiments.

Figure 3:
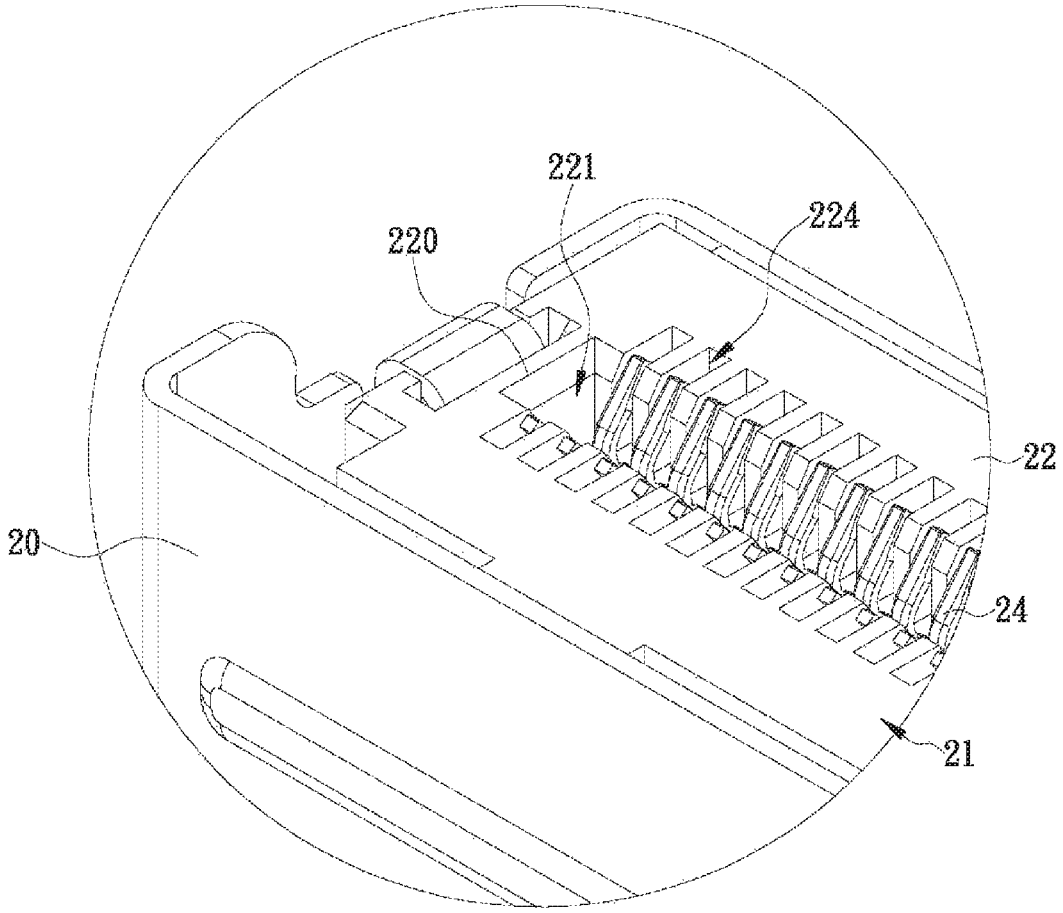
FIG. 3 is a partial enlarged view of the socket connector of the connector assembly in FIG. 2.

Referring to FIG. 2 and FIG. 3, the top side of socket connector 2 is provided with a socket connection portion 21. The left and right sides of the socket connector 2 are each provided with a fastening portion 23. The front side of the socket connector 2 is provided with an engaging portion 25. In this embodiment, the socket connector 2 includes a socket housing 20, an insulating socket body 22, and a plurality of metal socket terminals 24. The top side of the insulating socket body 22 is formed with a socket insertion hole 220. The socket insertion hole 220 is provided therein with a socket receiving space 221 in communication with the socket insertion hole 220. Two opposite inner sides of the insulating socket body 22 are each formed with a plurality of terminal grooves 224. The socket insertion hole 220, the terminal grooves 224, and the socket receiving space 221 communicate with one another. In other embodiments of the present disclosure, the insulating socket body 22 may dispense with the terminal grooves 224 or be additionally provided therein with a tongue plate in which the terminal grooves 224 are formed, in order to adapt the structure of the insulating socket body 22 to various types of connectors.

As shown in FIG. 2 and FIG. 3, the metal socket terminals 24 are fixedly provided in the insulating socket body 22 and are spaced apart from one another. The metal socket terminals 24 in this embodiment may be at least one of signal terminals, ground terminals, and power terminals, and are fitted in the terminal grooves 224 respectively such that each metal socket terminal 24 has a top end exposed through the socket receiving space 221 and a bottom end extending out of the insulating socket body 22 in order to be connected (e.g., soldered) to a circuit board or other component. It should be pointed out that the socket connection portion 21 serves mainly to connect electrically to the plug connector 3 and therefore may be modified in configuration as appropriate to the type of the connector assembly, provided that the socket connection portion 21 at least includes the metal socket terminals 24 fixedly provided in the insulating socket body 22. In this embodiment, and by way of example only, the socket connection portion 21 is implemented as a combination of the socket insertion hole 220 and the metal socket terminals 24 exposed through the socket receiving space 221.

In the embodiment shown in FIG. 2 and FIG. 3, the insulating socket body 22 is configured to be mounted in the socket housing 20, the fastening portions 23 are provided on the left and right sides of the insulating socket body 22 respectively, the engaging portion 25 is provided on the front side of the insulating socket body 22, and the fastening portions 23 and the engaging portion 25 are designed to be exposed from the socket housing 20. In other embodiments of the present disclosure, it is feasible for the insulating socket body 22 to have only the fastening portions 23 (i.e., without the engaging portion 25), or the fastening portions 23 and the engaging portion 25 may be provided on the socket housing 20 instead or on different components respectively, in order to meet product requirements. For example, the fastening portions 23 may be provided on the insulating socket body 22 while the engaging portion 25 is provided on the socket housing 20.

Figure 4:
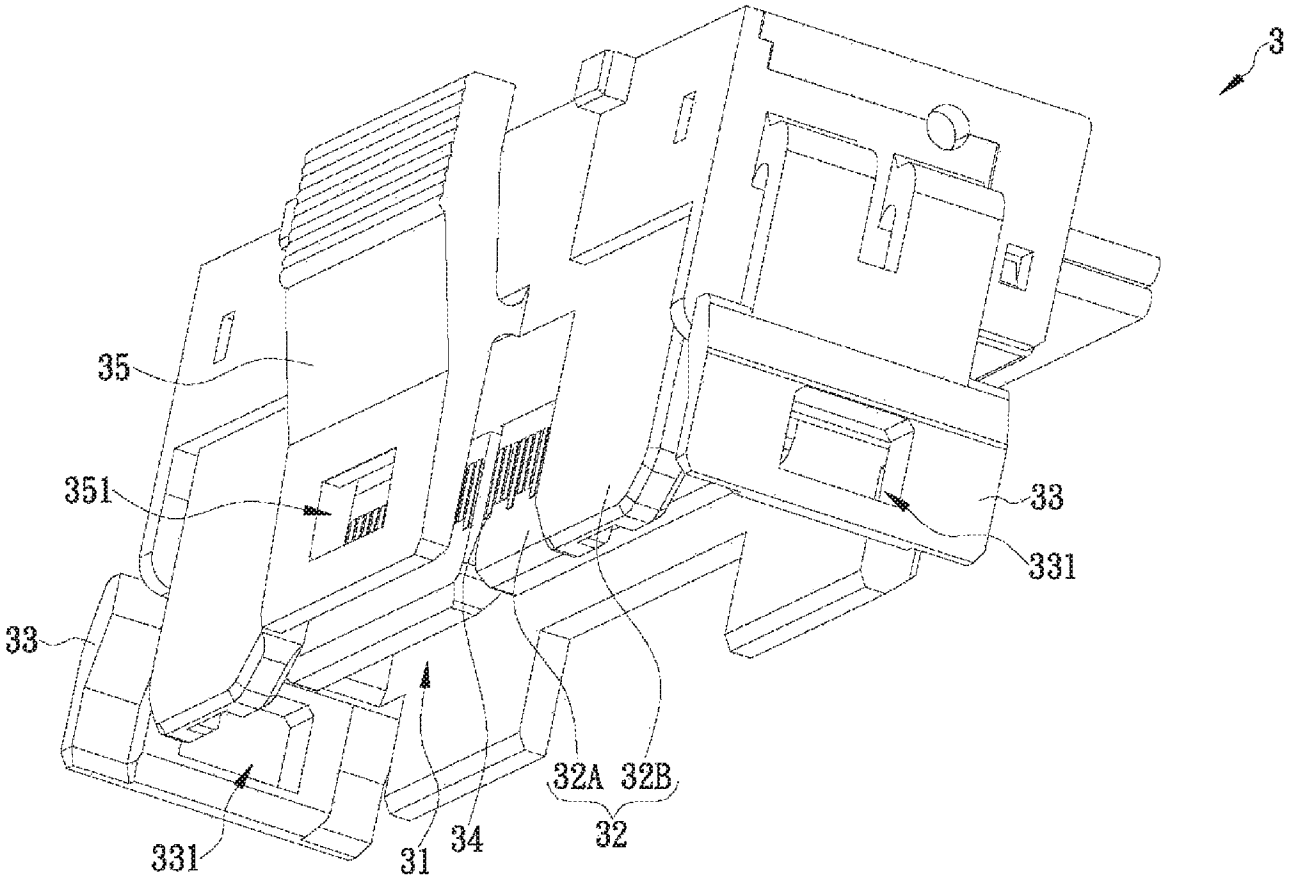
FIG. 4 is a perspective view of the plug connector of the connector assembly in FIG. 2.

Referring to FIG. 2 and FIG. 4, the bottom side of the plug connector 3 is provided with a plug connection portion 31. The left and right sides of the plug connector 3 are each provided with a first locking unit 33. The front side of the plug connector 3 is provided with a second locking unit 35. In this embodiment, each first locking unit 33 is bent into an L shape and has a free-standing bottom end spaced apart from the corresponding left side or right side of the plug connector 3, that is, there is a free-standing area adjacent to the bottom end of each first locking unit 33 (i.e., each first locking unit 33 has an inner wall portion that is adjacent to its bottom end and spaced apart from the left/right side of the plug connector 3). The second locking unit 35 is T-shaped and has a free-standing area top end and a free-standing bottom end that are both spaced apart from the front side of the plug connector 3, that is, there is a free-standing area adjacent to the top end of the second locking unit 35, and there is a free-standing area adjacent to the bottom end of the second locking unit 35 (i.e., the second locking unit 35 has an inner wall portion that is adjacent to its top end and spaced apart from the front side of the plug connector 3 and an inner wall portion that is adjacent to its bottom end and spaced apart from the front side of the plug connector 3). In other embodiments of the present disclosure, the first locking units 33 and the second locking unit 35 may be modified in exterior design (i.e., not necessarily L- or T-shaped) to meet product requirements, provided that the structures of the locking units have the intended locking and unlocking functions.

In the embodiment shown in FIG. 2 and FIG. 4, the plug connector 3 includes a plug housing 30, an insulating plug body 32, and a plurality of metal plug terminals 34. The metal plug terminals 34 are arranged on the insulating plug body 32 to form the plug connection portion 31. Each metal plug terminal 34 has an exposed end in the form of a gold finger and an opposite end in the form of a lead but is not necessarily so configured. The insulating plug body 32 depicted in FIG. 4 includes a tongue plate 32A and a base 32B. The tongue plate 32A and the base 32B may be integrally formed or assembled from separate components, depending on product requirements. The configuration of the plug connection portion 31 may also be modified according to product requirements or the configuration of the socket connection portion 21, provided that the plug connection portion 31 at least includes the metal plug terminals 34 fixedly provided in the insulating plug body 32. In this embodiment, and by way of example only, the plug connection portion 31 is implemented as a combination of the tongue plate 32A and the metal plug terminals 34 formed as gold fingers.

In the embodiment shown in FIG. 2 to FIG. 4, the insulating plug body 32 is configured to be mounted and fixed in the plug housing 30, the first locking units 33 are provided on the left and right sides of the insulating plug body 32 respectively, the second locking unit 35 is provided on the front side of the insulating plug body 32, and the first locking units 33 and the second locking unit 35 are designed to be exposed from the plug housing 30. Moreover, each first locking unit 33 is formed with a first opening 331 (or groove) in order to match the corresponding fastening portion 23 in configuration, and the second locking unit 35 is formed with a second opening 351 (or groove) in order to match the engaging portion 25 in configuration. In other embodiments of the present disclosure, it is feasible to adjust the exterior designs and locations of the first and the second locking units 33 and 35 so that the locking units are provided on the plug housing 30 instead or on different components respectively. In cases where the socket connector 2 has only the fastening portions 23 (i.e., no engaging portion 25), the insulating plug body 32 may have only the first locking units 33 (i.e., no second locking unit 35) too.

Referring to FIG. 2 to FIG. 5, when the plug connector 3 is physically connected to the socket connector 2, each metal plug terminal 34 of the plug connector 3 has one end inserted into the socket receiving space 221 through the socket insertion hole 220 and thus brought into contact with the exposed end of the corresponding metal socket terminal 24 to establish electrical connection between the socket connection portion 21 and the plug connection portion 31, thereby enabling an exchange of signals or electric current between the connectors. During the connecting process, each fastening portion 23 is also fastened to the corresponding first locking unit 33 (e.g., engaged in the first opening 331 of the corresponding first locking unit 33) to form a locked structure, and the engaging portion 25 is engaged with the second locking unit 35 (e.g., engaged in the second opening 351 of the second locking unit 35) to form another locked structure.

Figure 5:
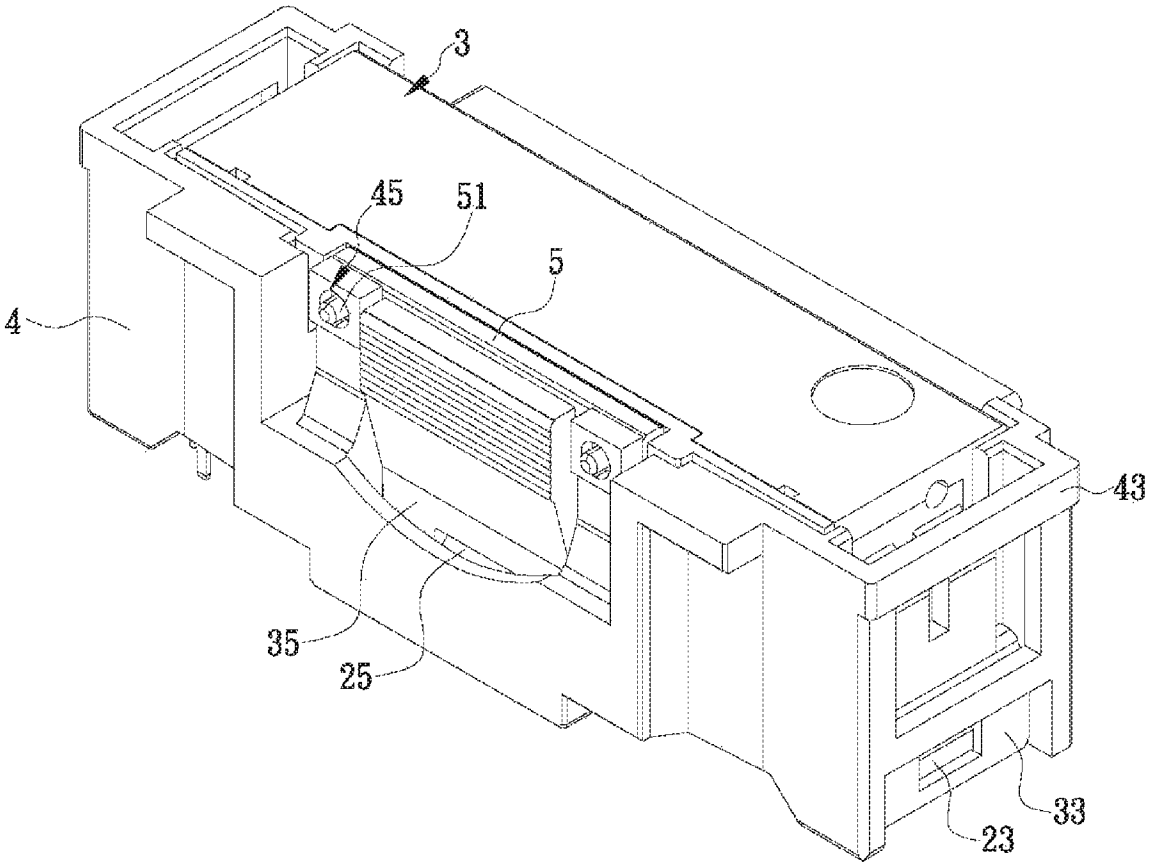
FIG. 5 is an assembled perspective view of the connector assembly in FIG.
Figure 6:
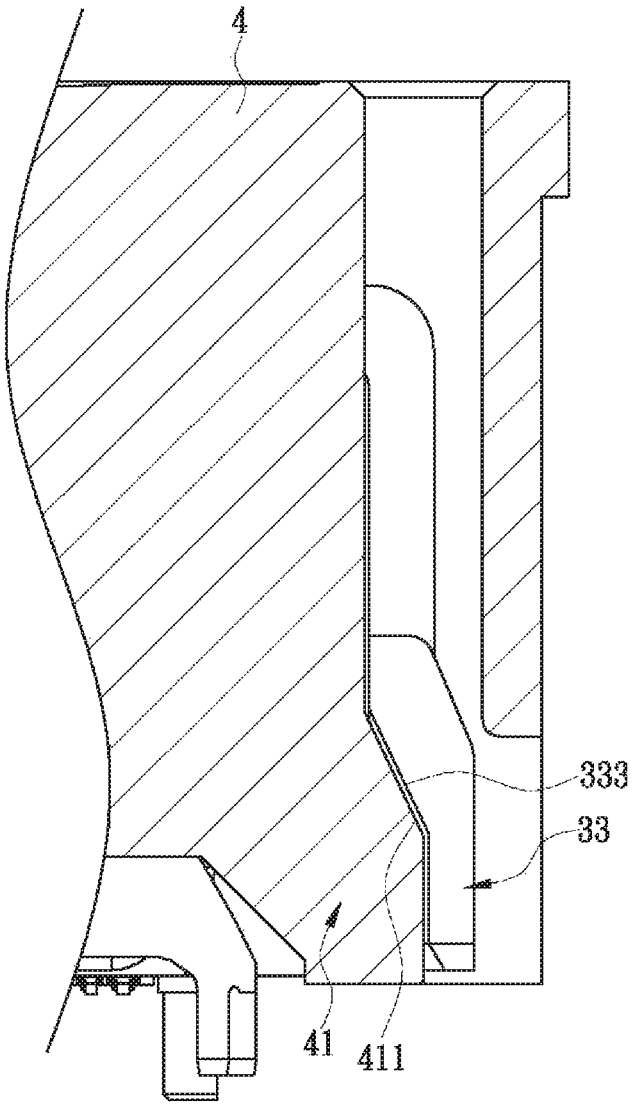
FIG. 6 is a partial sectional view of the connector assembly in FIG. 2.
Figure 7:
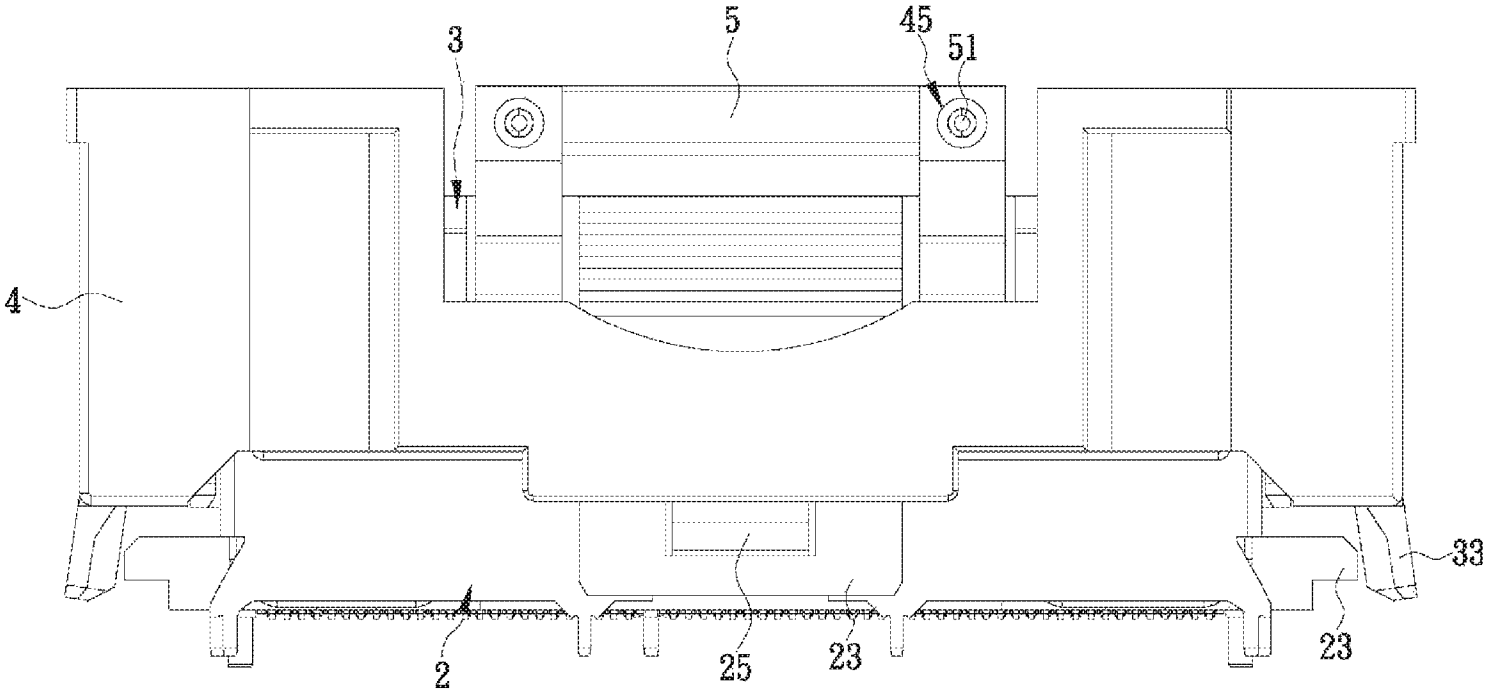
FIG. 7 is a front view of the connector assembly in FIG. 2, showing the first locking units in the unlocked state.
Figure 8:
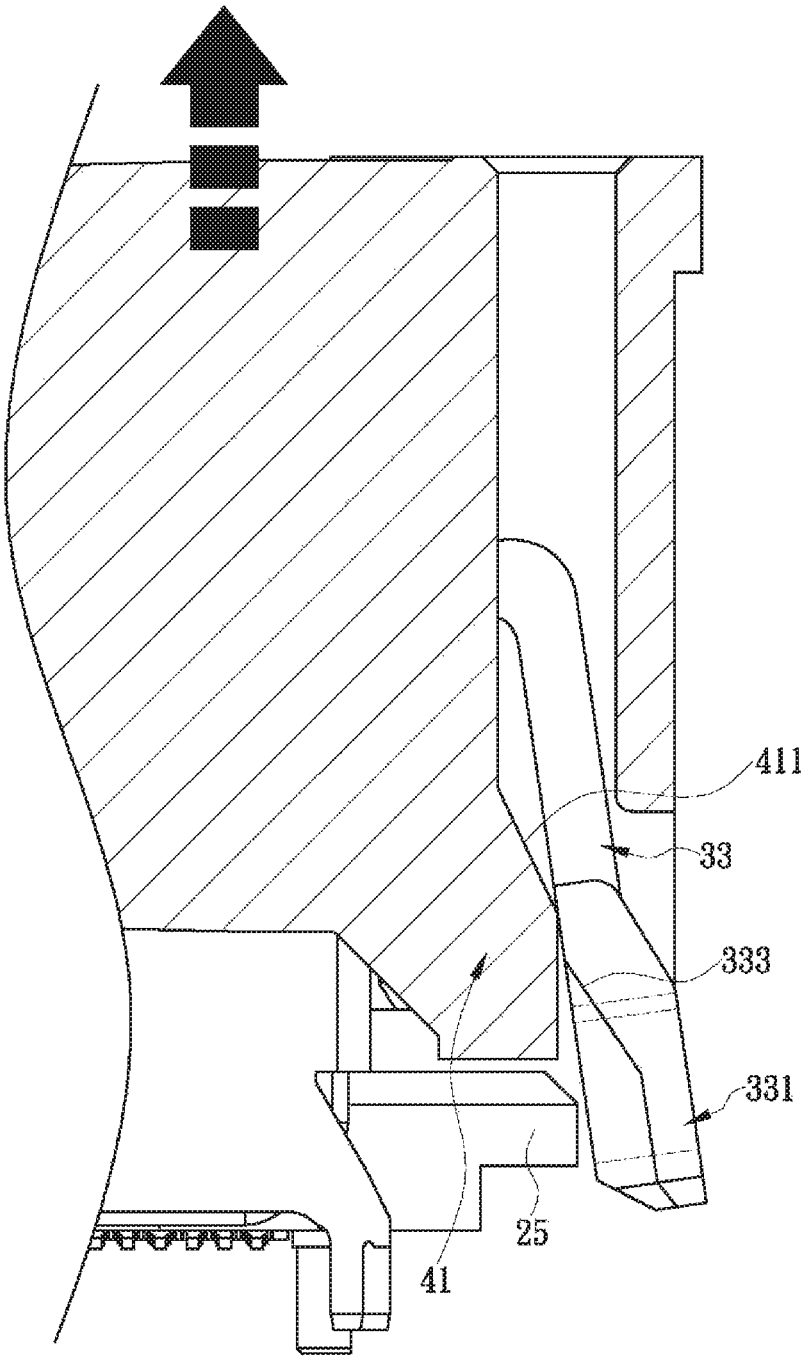
FIG. 8 is a partial sectional view of the connector assembly in FIG. 2, showing the first locking units in the unlocked state.

Referring to FIG. 2 and FIG. 6, the slidable locking frame 4 mountable around the plug connector 3 is mounted around the plug connector 3 (see FIG. 5), and the left and right sides of the slidable locking frame 4 are each provided with a pushing unit 41 located on the inner side of the corresponding first locking unit 33. When it is desired to disconnect the plug connector 3 from the socket connector 2, the disconnecting process begins by moving the slidable locking frame 4 toward the top side of the plug connector 3 (see FIG. 7) so that each pushing unit 41 pushes the corresponding first locking unit 33 outward. The first locking units 33 will be separated from the fastening portion 23 respectively and end up in the unlocked state (see FIG. 8). In this embodiment, referring to FIG. 8, the inner wall of each first locking unit 33 is provided with a first inclined contact surface 333, and the outer wall of each pushing unit 41 is provided with an inclined pushing surface 411, the goal being to make it easier for the pushing units 41 to push the first locking units 33 outward respectively. When the slidable locking frame 4 moves toward the top side of the plug connector 3 (i.e., in the direction indicated by the dashed-line arrow in FIG. 8), the inclined pushing surface 411 of each pushing unit 41 is pressed against and moved along the first inclined contact surface 333 of the corresponding first locking unit 33 so that the corresponding first locking unit 33 can be pushed outward away from the corresponding fastening portion 23 and into the unlocked state with greater ease.

Figure 9:
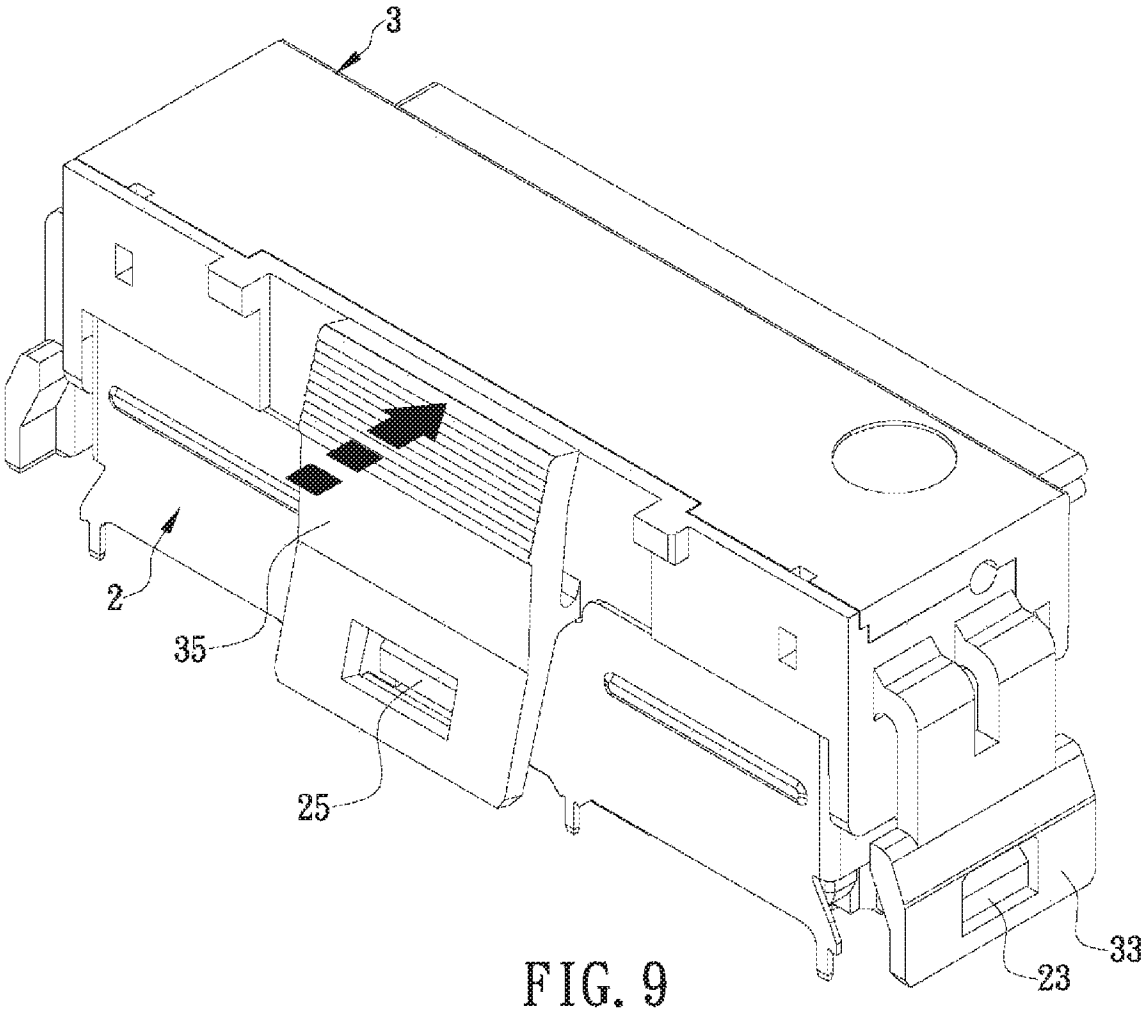
FIG. 9 is a perspective view of the connector assembly in FIG. 2, showing the second locking unit in the unlocked state.

With continued reference to FIG. 2 and FIG. 6, the next step of the disconnecting process is to press inward (i.e., in the direction indicated by the dashed-line arrow in FIG. 9) the free-standing area of the second locking unit 35 that is adjacent to the top end of the second locking unit 35. That is, pressing the free-standing top end of the second locking unit 35 along a direction toward the front side of the plug connector 3. By doing so, the second locking unit 35 will be separated or disengaged from the engaging portion 25 and end up in the unlocked state (see FIG. 9). Please note that the slidable locking frame 4 is omitted in FIG. 9 only to show the unlocked state more clearly. In actual use, the slidable locking frame 4 will stay on the plug connector 3 and therefore can be removed together with the plug connector 3. In addition, the order of the unlocking steps is not limited to that stated above. Depending on product design, it is feasible to unlock the second locking unit 35 before the slidable locking frame 4 is moved to unlock the first locking units 33. It can be known from the foregoing that the slidable locking frame 4 of the present disclosure can push the two first locking units 33 outward at the same time when moving toward the top side of the plug connector 3, thereby overcoming the aforementioned inadequacy of the conventional locking portions, i.e., one of a conventional pair of locking portions may remain locked while the other locking portion is in the unlocked state. The tactile feel of the slidable locking frame 4 being moved, or pulled, allows the user to know for sure whether the unlocked state is reached, so the chance of the user pulling the plug connector 3 forcibly away from the socket connector 2 and thereby damaging the plug connector 3 or the socket connector 2 is reduced.

To make the slidable locking frame 4 easily movable by its user, referring to FIG. 2 and FIG. 5, the left and right sides of the slidable locking frame 4 are each provided with a gripping and pulling portion 43. Each gripping and pulling portion 43 is located on the outer side of the corresponding first locking unit 33 so that a user can pull the slidable locking frame 4 upward by applying a lifting force to the gripping and pulling portions 43 with their fingers. It should be pointed out that, while the slidable locking frame 4 in this embodiment is depicted as integrally formed, the slidable locking frame 4 in another embodiment of the present disclosure may be assembled from a plurality of components, provided that the slidable locking frame 4 can unlock the two first locking units 33 simultaneously when so operated.

Apart from the tactile feel of the slidable locking frame 4 being pulled, a user can rely on at least one blocking member 5 in the connector assembly to know whether the first locking units 33 have entered the unlocked state, lest the second locking unit 35 be forcibly pressed, and the plug connector 3 forcibly pulled, before the first locking units 33 are effectively unlocked. Referring to FIG. 2 and FIG. 5, the blocking member 5 is movably located at a position corresponding to, or on, the inner side of the second locking unit 35 and corresponding to the free-standing top end of the second locking unit 35, and the front side of the slidable locking frame 4 is provided with at least one driving unit 45 connected to the blocking member 5 in order to move the blocking member 5 vertically. In the illustrated embodiment, for example, the front side of the blocking member 5 is provided with posts 51, the driving unit 45 is provided with apertures, and the posts 51 extend into the apertures respectively. When the slidable locking frame 4 moves toward the top side of the plug connector 3, the driving unit 45 drives the blocking member 5 upward, that is, toward the top side of the plug connector 3, such that the blocking member 5 leaves the position corresponding to the free-standing top end of the second locking unit 35. The free-standing top end of the second locking unit 35, that is, the free-standing area of the second locking unit 35 that is adjacent to the top end of the second locking unit 35, can therefore be pressed inward (see FIG. 9) to separate or disengaged the second locking unit 35 from the engaging portion 25 and thereby bring the second locking unit 35 into the unlocked state. If, however, the user pulls the slidable locking frame 4 by too short a distance to separate the first locking units 33 sufficiently from the fastening portions 23, a portion of the blocking member 5 will still correspond to the inner side of the second locking unit 35, making it impossible for the user to press the aforesaid free-standing area of the second locking unit 35 inward. If the user does press that area of the second locking unit 35 in this state, he or she will know that the first locking units 33 are not completely unlocked and hence be discouraged from any improper operation; as a result, the chance of damaging the connector assembly is effectively reduced.

While the present disclosure herein disclosed has been described by means of specific embodiments, numerous modifications and variations could be made thereto by those skilled in the art without departing from the scope of the present disclosure set forth in the claims.

What is claimed is:

1. A connector assembly, comprising:

a plug connector having:

a plug connection portion provided on a bottom side of the plug connector; and a first locking unit provided on each of a left side and a right side of the plug connector and having a free-standing bottom end spaced apart from the corresponding left side or right side of the plug connector;

a socket connector having:

a socket connection portion provided on a top side of the socket connector and configured to physically and electrically connect to the plug connection portion; and a fastening portion provided on each of a left side and a right side of the socket connector and configured to fasten the first locking unit to the fastening portion; and a slidable locking frame mountable around the plug connector and having:

a pushing unit provided on each of a left side and a right side of the slidable locking frame, corresponding to an inner side of a corresponding one of the first locking units, and configured to, when the slidable locking frame is mounted around the plug connector connected to the socket connector and moves along a direction towards a top side of the plug connector, push the corresponding first locking unit away from the right side or left side of the plug connector that corresponds to the first locking unit to separate the first locking unit fastened with the fastening portion from the fastening portion and bring the first locking unit fastened with the fastening portion into an unlocked state.

2. The connector assembly of claim 1, wherein the plug connector further has a second locking unit provided on a front side of the plug connector, the second locking unit has a free-standing top end and a free-standing bottom end, each of the free-standing top end and the free-standing bottom end of the second locking unit is spaced apart from the front side of the plug connector, and the socket connector further has an engaging portion provided on a front side of the socket connector and configured to:

engage the second locking unit when the plug connector is connected to the socket connector; and disengage from the second locking unit to enter into an unlocked state when the free-standing top end of the second locking unit is pressed to move along a direction toward the front side of the plug connector.

3. The connector assembly of claim 2, wherein the first locking unit has an inner wall having an inclined contact surface, the pushing unit has an outer wall having an inclined pushing surface, and when the slidable locking frame moves toward the top side of the plug connector, the inclined pushing surface is pressed against and moves along the first inclined contact surface such that the first locking unit is pushed outward and separated from the fastening portion to enter the unlocked state.

4. The connector assembly of claim 3, wherein the socket connector further comprises a socket housing, an insulating socket body and a plurality of metal socket terminals, the metal socket terminals are fixedly provided in the insulating socket body to form the socket connection portion, the insulating socket body is mounted in the socket housing, the fastening portion is provided on each of a left side and a right side of the insulating socket, the engaging portion is provided on a front side of the insulating socket body, and the fastening portion and the engaging portion are exposed from the socket housing.

5. The connector assembly of claim 4, wherein the plug connector further comprises a plug housing, an insulating plug body and a plurality of metal plug terminals, the metal plug terminals are fixedly provided in the insulating plug body to form the plug connection portion, the insulating plug body is mounted in the plug housing, the first locking unit is provided on each of a left side and a right side of the insulating plug body, the second locking unit is provided on a front side of the insulating plug body, and the first locking unit and the second locking unit are exposed from the plug housing.

6. The connector assembly of claim 5, further comprising at least one blocking member movably located at a position corresponding to an inner side of the second locking unit and the free-standing top end of the second locking unit, wherein the slidable locking frame has at least one driving unit provided on a front side of the slidable locking frame and configured to:

connect to the blocking member;

drive the blocking member to move vertically;

drive the blocking member to move toward the top side of the plug connector when the slidable locking frame moves toward the top side of the plug connector, such that the blocking member leaves the position corresponding to the free-standing top end of the second locking unit and allows the free-standing top end of the second locking unit to be pressed towards the front side of the plug connector to disengage the second locking unit from the engaging portion and bring the second locking unit into the unlocked state.

7. The connector assembly of claim 6, wherein a gripping and pulling portion is provided on each of the left side and the right side of the slidable locking frame, and the gripping and pulling portion is located on an outer side of a corresponding one of the first locking units.

8. The connector assembly of claim 7, wherein the slidable locking frame is integrally formed.

9. A plug connector with a slidable locking frame, comprising:

the plug connector, configured to connect to a socket connector and having:

a plug connection portion provided on a bottom side of the plug connector and configured to electrically connect to a socket connector when the plug connector is connected to the socket connector; and a first locking unit, provided on each of a left side and a right side of the plug connector, having a free-standing bottom end spaced apart from the corresponding left side or right side of the plug connector, and configured to be fastened to a fastening portion of the socket connector; and the slidable locking frame, mountable around the plug connector and having:

a pushing unit provided on each of a left side and a right side of the slidable locking frame, corresponding to an inner side of a corresponding one of the first locking units, and configured to, when the slidable locking frame is mounted around the plug connector connected to the socket connector and moves along a direction towards a top side of the plug connector, push the corresponding first locking unit away from the right side or left side of the plug connector that corresponds to the first locking unit to separate the first locking unit fastened with the fastening portion from the fastening portion and bring the first locking unit fastened with the fastening portion into an unlocked state.

10. The plug connector of claim 9, wherein the plug connector further has a second locking unit provided on a front side of the plug connector, having a free-standing top end and a free-standing bottom end that are both spaced apart from the front side of the plug connector, and configured to:

engage an engaging portion of the socket connector when the plug connector is connected to the socket connector; and disengage from the engaging portion to enter into an unlocked state when the free-standing top end of the second locking unit is pressed to move along a direction toward the front side of the plug connector.

11. The plug connector of claim 10, wherein the first locking unit has an inner wall having an inclined contact surface, the pushing unit has an outer wall having an inclined pushing surface, and when the slidable locking frame moves toward the top side of the plug connector, the inclined pushing surface is pressed against and moves along the first inclined contact surface such that the first locking unit is pushed outward and separated from the fastening portion to enter the unlocked state.

12. The plug connector of claim 11, wherein the plug connector further comprises a plug housing, an insulating plug body and a plurality of metal plug terminals, the metal plug terminals are fixedly provided in the insulating plug body to form the plug connection portion, the insulating plug body is mounted in the plug housing, the first locking unit is provided on each of a left side and a right side of the insulating plug body, the second locking unit is provided on a front side of the insulating plug body, and the first locking unit and the second locking unit are exposed from the plug housing.

13. The plug connector of claim 12, further comprising at least one blocking member movably located at a position corresponding to an inner side of the second locking unit and the free-standing top end of the second locking unit, wherein the slidable locking frame has at least one driving unit provided on a front side of the slidable locking frame and configured to:

connect to the blocking member, drive the blocking member to move vertically; and drive the blocking member to move toward the top side of the plug connector when the slidable locking frame moves toward the top side of the plug connector, such that the blocking member leaves the position corresponding to the free-standing top end of the second locking unit and allows the free-standing top end of the second locking unit to be pressed towards the front side of the plug connector to disengage the second locking unit from the engaging portion and bring the second locking unit into the unlocked state.

14. The plug connector of claim 13, wherein a gripping and pulling portion is provided on each of the left side and the right side of the slidable locking frame, and the gripping and pulling portion is located on an outer side of a corresponding one of the first locking units.

15. The plug connector of claim 14, wherein the slidable locking frame is integrally formed.

* * * * *